US006003278A

United States Patent [19]

Weaver et al.

[11] Patent Number: 6,003,278

[45] Date of Patent: Dec. 21, 1999

[54] MONOLITHIC STUD FORM FOR CONCRETE WALL PRODUCTION

[75] Inventors: Gary L. Weaver, Ephrata; Robert G. Martin, Narvon, both of Pa.

[73] Assignee: We-Mar, Inc., Ephrata, Pa.

[21] Appl. No.: 08/989,333

[22] Filed: Dec. 11, 1997

[51] Int. Cl.[6] ..... E04B 1/16

[52] U.S. Cl. ..... 52/414; 52/309.12; 52/309.17; 52/319; 52/405.1; 52/405.3; 249/26; 249/28; 249/35

[58] Field of Search ..... 52/319, 405.1, 52/405.3, 309.12, 309.17, 414; 249/26, 28, 35

[56] References Cited

U.S. PATENT DOCUMENTS

| | | |
|---|---|---|
| 518,292 | 4/1894 | Tickner et al. . |
| 1,124,404 | 1/1915 | Featherstone . |
| 1,129,658 | 2/1915 | Foy . |
| 1,131,479 | 3/1915 | Dale . |
| 1,238,858 | 9/1917 | Widmer . |
| 1,313,630 | 8/1919 | Galan . |
| 1,363,391 | 12/1920 | Carpenter . |
| 1,421,007 | 6/1922 | Howell . |
| 1,436,033 | 11/1922 | Hahn . |
| 1,439,281 | 12/1922 | Ambursen . |
| 1,499,572 | 7/1924 | Eldridge . |
| 1,537,278 | 5/1925 | Wilson et al. . |
| 1,592,070 | 7/1926 | Blake . |
| 1,757,763 | 5/1930 | Betzler . |
| 1,773,168 | 8/1930 | Brostrom . |
| 1,778,345 | 10/1930 | Venzie . |
| 1,834,892 | 12/1931 | Betzler . |
| 1,840,304 | 1/1932 | Branson . |
| 2,058,285 | 10/1936 | Amescua . |
| 2,111,577 | 3/1938 | Thomas . |
| 2,184,464 | 12/1939 | Myers . |
| 2,208,589 | 7/1940 | Leemhuis . |
| 2,266,007 | 12/1941 | Copeman . |
| 2,306,548 | 12/1942 | Leemhuis . |
| 2,321,813 | 6/1943 | Henzel . |
| 2,451,951 | 10/1948 | Howat . |
| 2,514,805 | 7/1950 | Seymour . |
| 2,592,634 | 4/1952 | Wilson . |
| 2,630,614 | 3/1953 | Peterson . |
| 2,723,107 | 11/1955 | Parker . |
| 2,775,019 | 12/1956 | Bemis . |
| 2,823,426 | 2/1958 | Dunlap . |

(List continued on next page.)

FOREIGN PATENT DOCUMENTS

| | | |
|---|---|---|
| 0392610 | 10/1990 | European Pat. Off. . |
| 610611 | 9/1926 | France . |
| 2470218 | 11/1979 | France . |
| 3801417 | 12/1988 | Germany . |
| 135680 | 10/1929 | Switzerland . |
| 514941 | 5/1976 | U.S.S.R. . |
| WO8901081 | 9/1989 | WIPO . |

OTHER PUBLICATIONS

Macwall Concrete Systems Brochure.

Burke—The Concrete Supermarket Brochure.

Del Zotto Mfg. Precast Concrete Wall Panels Brochure.

Machnik Precast Concrete Wall Panel, Alfred Machnik Research Report No. 78–77, Foundation System, Sep. 10, 1980.

Edwards Precast, Weather Cast Building System Brochure.

Dayton Superior Sandwich Panel Information.

Royal Wall Systems Brochure.

*Primary Examiner*—Christopher T. Kent

*Attorney, Agent, or Firm*—Volpe and Koenig, P.C.

[57] ABSTRACT

A stud form and system for forming a preformed concrete wall panel having a solid portion and a plurality of vertical concrete studs joined to the solid portion. The stud form includes a substantially U-shaped channel having a face portion that defines an elongated plane and leg portions extending along side of and away from the elongated plane to define a predetermined channel depth. The stud form further includes means for integrally connecting the stud form to the solid portion of the wall panel with the channel opened toward the solid portion.

17 Claims, 6 Drawing Sheets

U.S. PATENT DOCUMENTS

| | | |
|---|---|---|
| 2,823,442 | 2/1958 | Miller et al. . |
| 2,902,745 | 9/1959 | Brigard et al. . |
| 2,924,962 | 2/1960 | Nettle . |
| 2,993,637 | 7/1961 | Lacey . |
| 3,146,497 | 9/1964 | Short et al. . |
| 3,245,185 | 4/1966 | Rowe . |
| 3,246,828 | 4/1966 | Branscum et al. . |
| 3,295,818 | 1/1967 | Kreier, Jr. . |
| 3,310,917 | 3/1967 | Simon . |
| 3,317,178 | 5/1967 | Kreier, Jr. . |
| 3,330,437 | 7/1967 | Bellamy . |
| 3,380,703 | 4/1968 | Zastrow . |
| 3,415,023 | 12/1968 | Lebreton . |
| 3,434,689 | 3/1969 | Aftreth . |
| 3,515,779 | 6/1970 | Jones . |
| 3,553,797 | 1/1971 | Horton . |
| 3,638,902 | 2/1972 | Bergan . |
| 3,885,008 | 5/1975 | Martin . |
| 3,886,699 | 6/1975 | Bergmann, Jr. . |
| 3,892,098 | 7/1975 | Kobori . |
| 3,930,633 | 1/1976 | Wolf . |
| 4,017,051 | 4/1977 | Scott et al. . |
| 4,033,545 | 7/1977 | Duwe et al. . |
| 4,090,336 | 5/1978 | Carroll . |
| 4,141,532 | 2/1979 | Wall . |
| 4,159,100 | 6/1979 | Landowski . |
| 4,163,349 | 8/1979 | Smith . |
| 4,194,333 | 3/1980 | Paton et al. . |
| 4,241,555 | 12/1980 | Dickens et al. . |
| 4,291,513 | 9/1981 | Ankarswed . |
| 4,365,453 | 12/1982 | Lowe . |
| 4,380,887 | 4/1983 | Lee . |
| 4,422,997 | 12/1983 | Machnik . |
| 4,426,060 | 1/1984 | Csont . |
| 4,432,176 | 2/1984 | Balzer . |
| 4,494,353 | 1/1985 | Lewis . |
| 4,512,126 | 4/1985 | Walston . |
| 4,532,745 | 8/1985 | Kinard . |
| 4,554,124 | 11/1985 | Sudrabin . |
| 4,570,398 | 2/1986 | Zimmerman . |
| 4,605,529 | 8/1986 | Zimmerman . |
| 4,619,032 | 10/1986 | Sudrabin . |
| 4,624,089 | 11/1986 | Dunker . |
| 4,641,468 | 2/1987 | Slater . |
| 4,751,803 | 6/1988 | Zimmerman . |
| 4,815,243 | 3/1989 | Pardo . |
| 4,841,702 | 6/1989 | Huettemann . |
| 4,862,660 | 9/1989 | Raymond . |
| 4,934,121 | 6/1990 | Zimmerman . |
| 4,947,600 | 8/1990 | Porter . |
| 4,974,381 | 12/1990 | Marks . |
| 5,055,252 | 10/1991 | Zimmerman . |
| 5,111,628 | 5/1992 | Desjoyaux et al. ..... 249/35 X |
| 5,313,753 | 5/1994 | Sanger . |
| 5,381,635 | 1/1995 | Sanger . |

MONOLITHIC STUD FORM FOR CONCRETE WALL PRODUCTION

BACKGROUND OF THE INVENTION

1. Field of the Invention

The present invention relates generally to the field of prefabricated concrete wall construction, and more specifically, to a prefabricated concrete stud wall panel and method of forming the same.

2. Description of the Prior Art

In response to problems with traditional block construction methods, prefabricated wall panels were developed for rapid construction of buildings. Prefabricated wall panels are shown in U.S. Pat. Nos. 4,751,803, 4,934,121, 5,055,252 and 5,313,753. Two types of prefabricated concrete walls which are commonly used are cavity walls having open pockets between spaced vertical studs and planar walls having insulation panels between the vertical studs to form a substantially planar surface. While both of these types of prefabricated wall panels are generally superior to traditional block construction in terms of costs, performance and reliability, there are still problems associated with both.

Many cavity walls use preformed concrete studs from a prior pour where they are formed separately from the top and base beams. A subsequent pour is then necessary to integrate the vertical studs with the top and base beams. As a result, walls formed in this manner require additional pouring and curing time and are often weaker than walls formed from a monolithic pour. Monolithic concrete cavity walls are typically formed by pouring concrete into frames which have forming channels for the vertical studs and the top and base beams. However, it is often difficult to remove the finished wall panel from the forming channels without damaging the concrete studs or beams.

In addition to the above, it is often necessary provide a wood stud at the face of the concrete studs. This is often accomplished by laying wood strips in the forming channels prior to pouring. Typically, the wood strips have a series of nails projecting therefrom and the concrete cures around the nails to secure the wood studs. The process of providing nails in each of the wood strips is time consuming and adds to the manufacturing costs. Additionally, the wood strips are susceptible to cracking and warping, particularly when they are exposed to the wet concrete.

The planar walls are typically formed by placing wall studs, insulation, and reinforcing means in a forming assembly and filling the assembly with concrete. The studs and insulation are generally provided with projections which are surrounded by the concrete to integrate the studs and insulation into the wall. Planar walls which utilize wood studs often experience the same problems therewith as the cavity walls do. U.S. Pat. Nos. 5,313,753 and 5,381,635 suggest mounting other common studs, metal or plastic studs, to the front faces of the concrete studs. However, these studs are merely secured to the front of the concrete studs by narrow flanges which may pull from the concrete. As the size of the flanges is increased, the chance that the concrete will fail to flow between and around the flanges also increases. Another problem associated with these metal and plastic studs on the vertical concrete face is that there is no way of passing service lines, such as, plumbing and electrical wiring, through the vertical studs.

Accordingly, there exists a need for a monolithic concrete wall which is easy to form, includes integral attachment stud surfaces and overcomes the disadvantages of the prior art.

SUMMARY OF THE INVENTION

The present invention generally relates to a stud form of a type used in forming a preformed concrete wall panel having a solid portion and a plurality of vertical concrete studs joined to the solid portion. The stud form includes a substantially U-shaped channel having a face portion that defines an (elongated plane and leg portions extending along side of and away from the elongated plane to define a predetermined channel depth. The stud form further includes means for integrally connecting the stud form to the solid portion of the wall panel with the channel opened toward the solid portion.

The present invention also includes preformed concrete walls which incorporate the stud form and a system for forming such.

DETAILED DESCRIPTION OF THE PREFERRED EMBODIMENT

Figure 1:
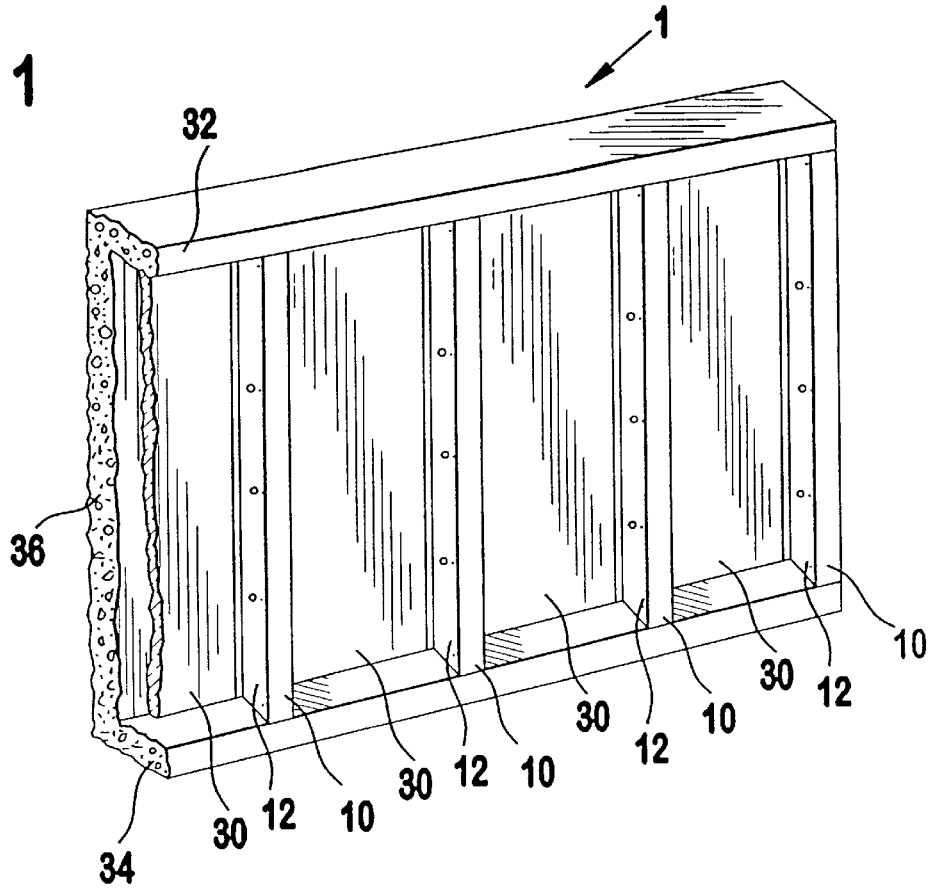
FIG. 1 is an isometric view of a cavity wall panel made in accordance with the present invention.

The preferred embodiments will be described with reference to the drawing figures wherein like numerals represent like elements throughout. References to orientation refer to the orientation of an installed wall panel and are for clarity only.

FIG. 1 shows a preferred cavity wall panel 1 made in accordance with the present invention. The cavity wall panel 1 generally comprises spaced vertical studs 10 extending between top beam 32 and base beam 34. The vertical studs 10 include a filled stud channel 12 formed integral with the wall panel 1. Insulation panels 30 are recessed from the inside face of the wall 1 and extend between the vertical studs 10 and top and base beams 32 and 34. A concrete surface 36 extends along the back of the wall panel 1.

Figure 2:
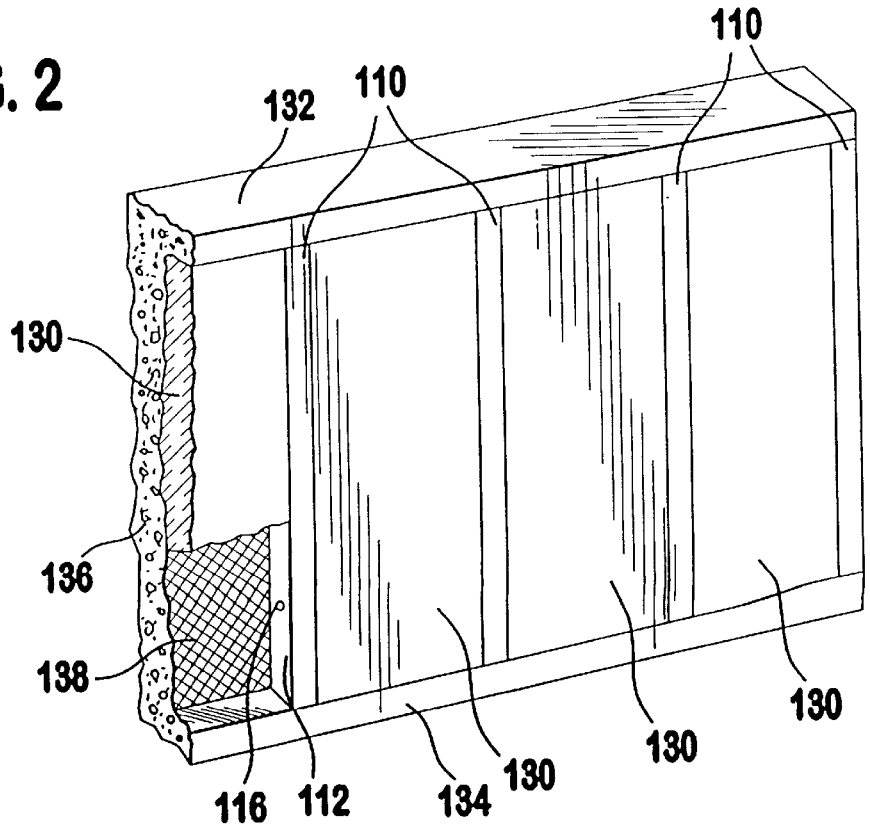
FIG. 2 is an isometric view of a planar wall panel made in accordance with the present invention.

FIG. 2 shows a preferred planar wall panel 101 made in accordance with the present invention. The planar wall panel 101 generally comprises spaced vertical studs 110 extending between top beam 132 and base beam 134. The vertical studs include a filled stud channel 112 which is integral with the wall panel 101. Insulation panels 130 extend between the vertical studs 110 and with studs 110 form a planar inside face on the wall 101. The outside face of the wall has a planer concrete surface 136. A wire lath 138 may also be included behind the insulation panels across the entire area of the wall panel 101.

Figure 3:
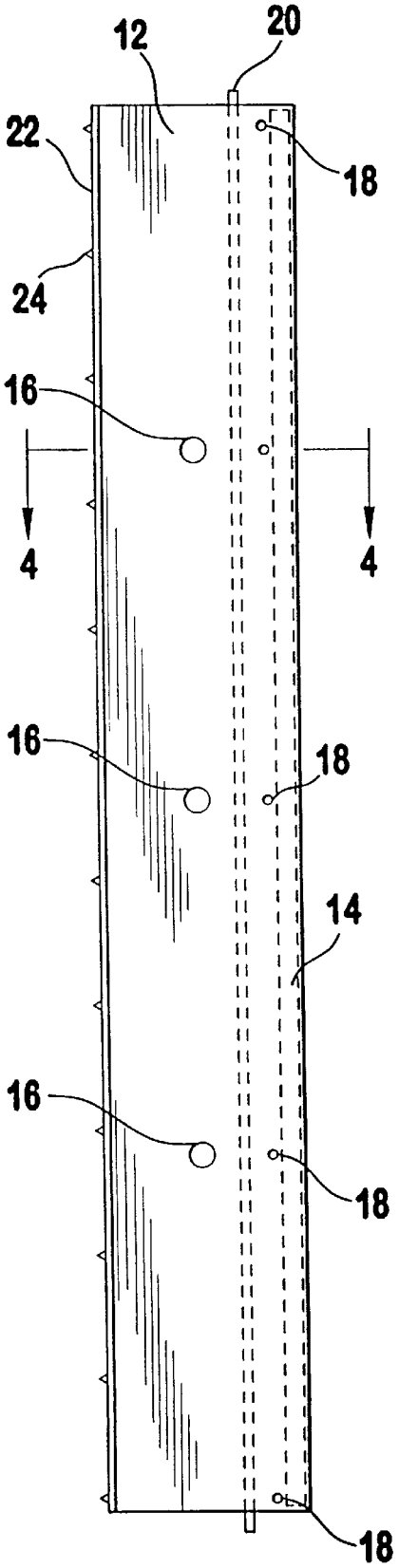
FIG. 3 is an elevation view of a vertical stud form used in the wall panel shown in FIG. 1.
Figure 4:
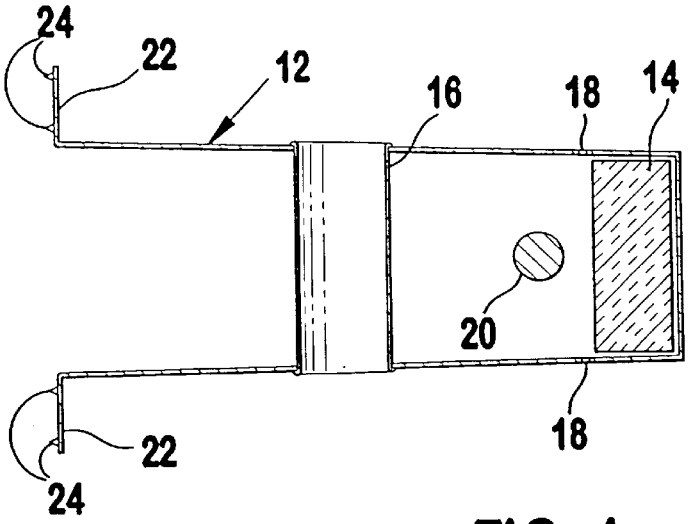
FIG. 4 is a section view taken along the line 4—4 in FIG. 3.

The preferred stud form 12 used in the cavity wall panel 1 is shown in FIGS. 3 and 4. It is preferably made from metal or plastic and forms an integral part of the vertical studs 10. The stud form 12 is generally a U-shaped channel. It is preferably slightly longer than the length of a vertical stud 10 so that it extends into the top and base beams 32 and 34 of the finished wall. Rebar 20 is positioned in each of the stud forms 12 to tie the vertical studs with the top and base beams 32 and 34. Flanges 22 extend outward from each open end of the channel and are substantially parallel to the face of the form 12. Each of the flanges 22 has a plurality of projections 24 extending therefrom for maintaining the insulation panels 30 in position during forming of the cavity wall panel 1, as will be described in more detail hereinafter. Insulation 14 is placed in the stud form 12 U-channel and extends the length thereof. The insulation 14 provides an area in each vertical stud 10 which is substantially concrete free and allows screws or other fasteners to be set directly into the stud forms 12 in the finished wall. Since finishing materials, such as sheet rock, can be fastened directly to the integral stud forms 12, separate nailing strips are not required.

As shown in FIGS. 3 and 4, sleeves 16 extend between the sides of the stud form 12 at various positions along its length. Each end of each sleeve 16 is preferably flattened over to hold the side walls of the stud form 12 between the ends of the sleeve 16. In the finished wall panel 1, the sleeves 16 are enclosed in the cured concrete and thereby integrate the forms 12 with the finished wall. The sleeves 16 also provide a conduit for electrical wires, plumbing and the like.

A plurality of weep holes 18 are provided through each side of the stud form 12 near the front thereof. The weep holes 18 are checked during pouring of the cavity wall panel 1 to ensure that concrete is properly flowing to the front of the stud form 12.

Figure 5:
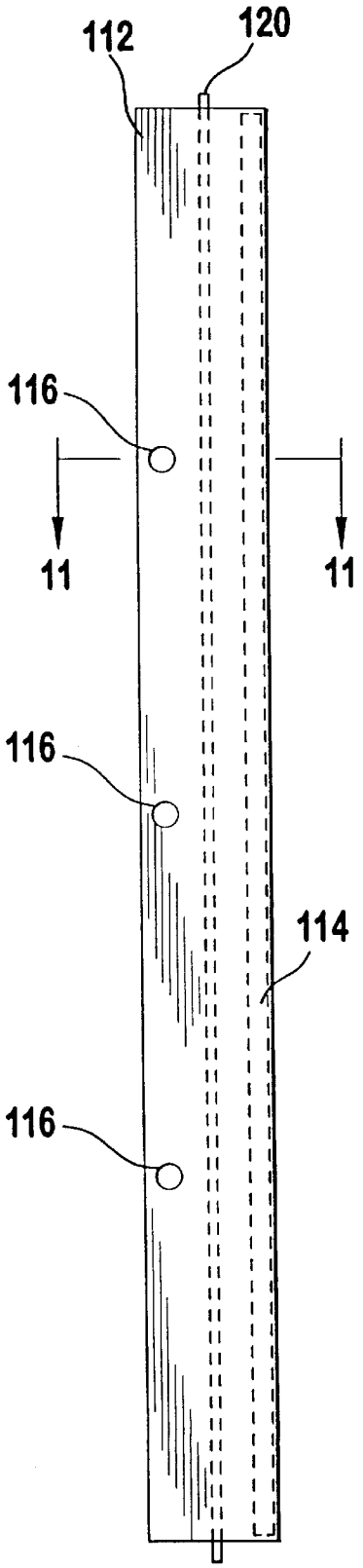
FIG. 5 is an elevation view of a vertical stud form used in the wall panel shown in FIG. 2.
Figure 6:
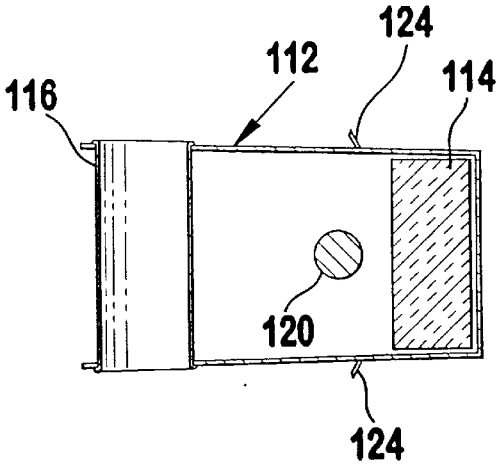
FIG. 6 is a section view taken along the line 6—6 in FIG. 5.

The vertical stud form 112 used to form the planar wall panels 101 is shown in FIGS. 5 and 6. The stud form 112 is generally the same as the stud form 12 used in the cavity wall panel 1 except that the planar wall panel stud form 112 does not have flanges for supporting the insulation since the insulation 130 will be adjacent to the stud form 112. The stud form 112 may be provided with projections 124 to hold the insulation panels 130.

Figure 7:
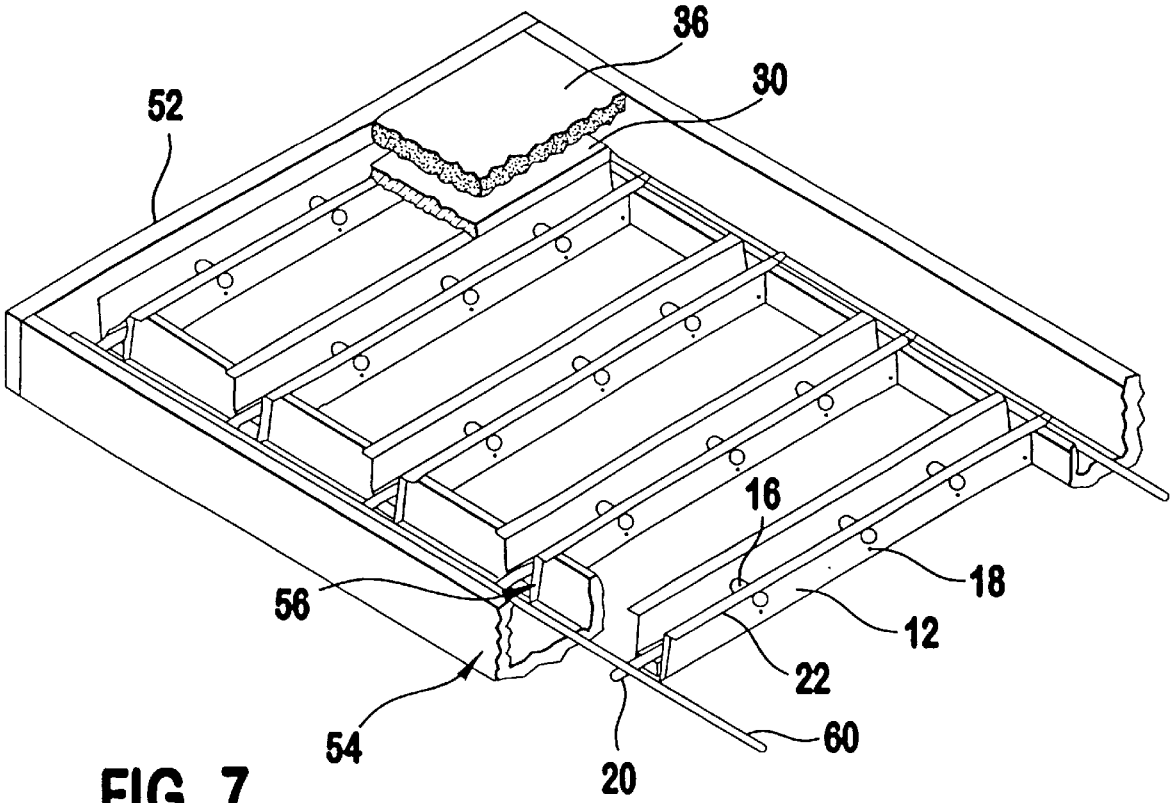
FIG. 7 is an isometric view showing an assembly for the formation of the wall panel shown in FIG. 1.
Figure 9:
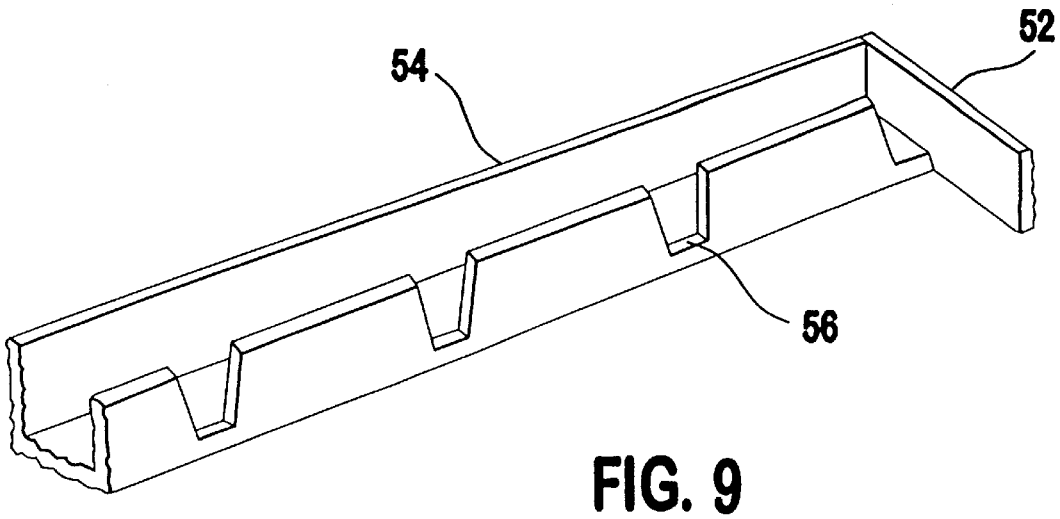
FIG. 9 is an isometric view of a portion of the top and bottom forming members.

Formation of a cavity wall panel 1 will now be described with reference to FIGS. 7 and 9. FIG. 9 shows the intersection of two walls of the forming assembly 50. The forming assembly 50 preferably comprises linear side walls 52 and top and bottom forming channels 54. The interior sides of the top and bottom forming channels 54 have a number of spaced notches 56 for receiving the vertical stud forms 12. The notches 56 are preferably centered at sixteen or twenty-four inches depending on the desired configuration of the wall panel 1. As can be seen in FIG. 9, the end notches 56 preferably butt against the side walls 52 to allow the end vertical stud forms 12, which have a flange along only one edge, to be placed against the framing side walls 52.

Figure 10:
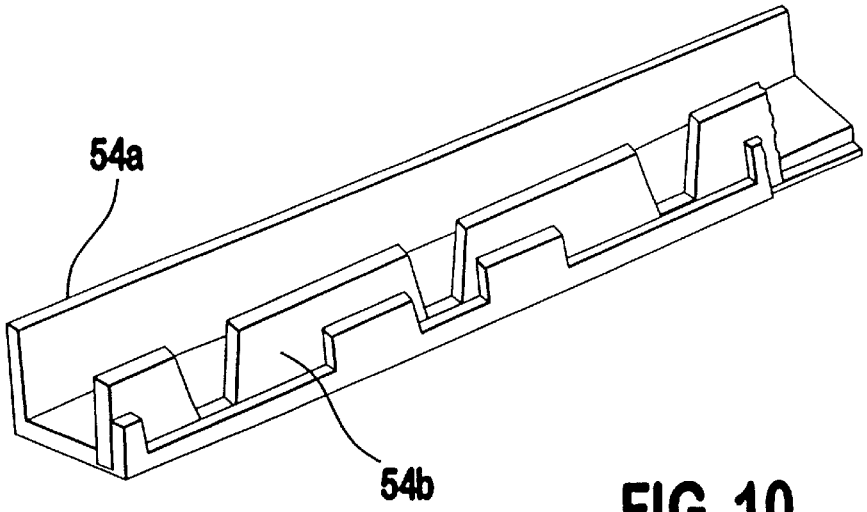
FIG. 10 is an alternate embodiment of the top and bottom forming channels.

In an alternate embodiment, shown in FIG. 10, the top and bottom forming channels 54 have an interchangeable inner wall **54*b* which fits into a permanent section of the channel 54*a*. This allows varying inner channel sections 54*b*, having differently spaced notches, at sixteen or twenty-four inch centers for example, to be quickly interchanged to produce a cavity wall panel 1** having the desired configuration.

With the forming assembly 50 in its desired configuration, the vertical stud forms 12 are laid in the notches 56. The stud forms 12 preferably extend slightly into the top and bottom channels 54 to lock them into the top and base beams 32 and 34 of the finished wall panel 1. The rebar 20 in each stud form 12 also extends into the top and base channels 54. The vertical rebar 20 is attached to horizontal rebar 60 extending in the top and bottom channels 54. With the vertical stud forms 12 in place, the insulation panels 30 are placed on the flanges 22 of adjacent stud forms 12 and extend between the top and bottom channels 54 and from one stud form flange 22 to the adjacent stud form flange 22. In this position, the insulation does not cover the top and bottom channels 54 or the vertical stud form 12 U-channels. The flange projections 24 maintain the insulation panels 30 in position daring pouring of the concrete. A monolithic concrete pour is used to fill the forming assembly 50. The concrete fills the top and bottom channels 54 to form the top and base beams 32 and 34 and the vertical stud forms 12 to form the vertical studs 10. The concrete also provides a solid back wall 36 of approximately two inches.

After the concrete cures, the wall panel 1 is lifted from the forming assembly 50. Since the vertical stud forms 12 are integral with the wall panel 1, the likelihood that the vertical studs 10 will crack or be improperly formed is greatly reduced. Furthermore, since the sleeves 16 are integral with the wall panel 1, there is no need for drilling or cutting conduit passages in the vertical studs 10.

Figure 11:
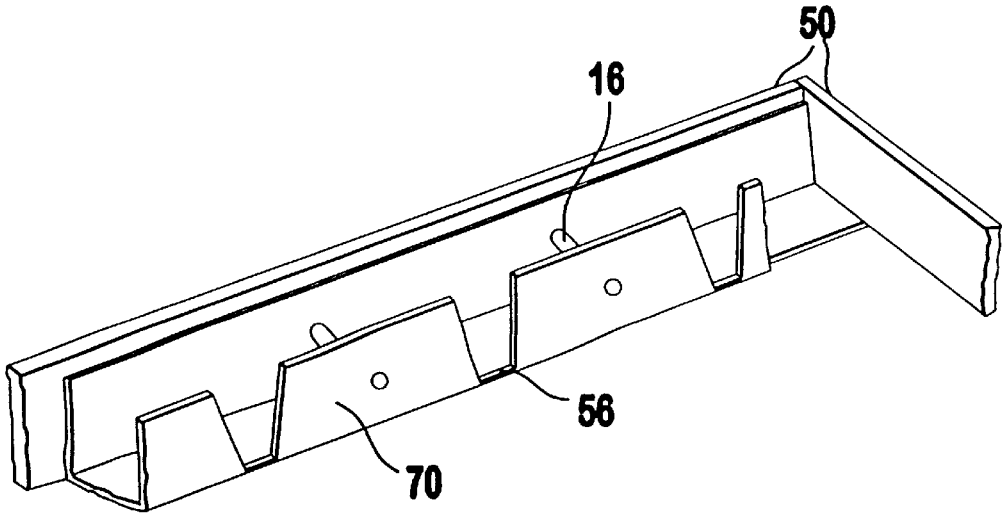
FIG. 11 is an isometric view of a horizontal stud form positioned in the forming assembly.

In an alternate embodiment of the cavity wall 1, all of the forming members 50 are linear walls. The top and bottom channels 54 are formed by horizontal stud forms 70 placed within the forming assembly 50, as shown in FIG. 11. The horizontal stud forms 70 are similar to the vertical stud forms 12 and also form an integral part of the wall panel 1. The horizontal stud forms 70 differ from the vertical stud forms 12 in that each has a side wall with notches 56 to receive the vertical stud forms 12. Formation of the wall panel 1 is simplified since the wall panel 1 does not require lifting from the top and bottom channels. Instead, the forming members 50 can simply be disassembled.

Figure 8:
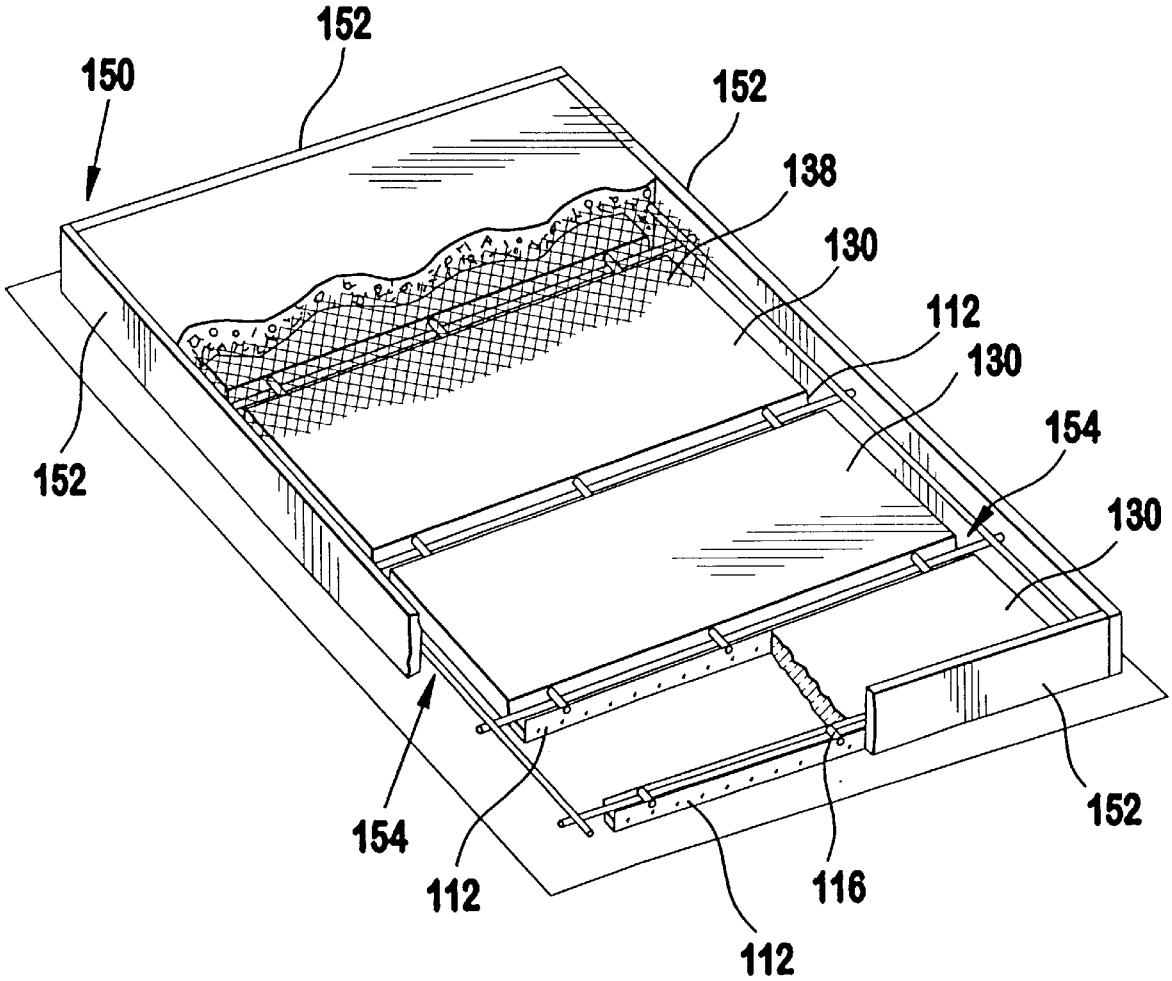
FIG. 8 is an isometric view showing an assembly for the formation of the wall panel shown in FIG. 2.

FIG. 8 shows the formation of a planar wall panel 101. Forming members 152 are connected to define forming assembly 150. In the preferred embodiment, a stud form 112 is laid flat in the frame so that it extends along one of the end frame members 150. Additional stud forms 112 are placed parallel to the first stud form 112 on sixteen or twenty four inch centers. The studs forms 112 have a length which is less than the length of forming members 152 whereby channels 154 exist at the top and bottom of the forming assembly 150.

Four inch thick expanded foam insulation panels 130, extending the length of the stud forms 112, are placed between adjacent stud forms 112. Reinforcing steel bars 160, extending the length of the wall panel 101, are placed in the top and bottom channels 154. A wire mesh 138 is laid over the entire surface within the framing members. Conventional wet concrete is poured into the form 150, filling all of the empty space within the form and providing a slab of at least two inch (2") thick concrete along the entire back of the wall. The concrete will fill the top and bottom channels and form the top and bottom beams 132 and 134. The concrete surrounds the sleeves 116 and thereby forms the integral vertical studs 110.

I claim:

1. A stud form of a type used in forming a preformed concrete wall panel having a solid portion and a plurality of vertical concrete studs joined to the solid portion, the stud form characterized by:

a substantially U-shaped channel having a face portion that defines an elongated plane and leg portions extending along side of and away from the elongated plane to define a predetermined channel depth; and means for integrally connecting the stud form to the solid portion of the wall panel with the channel opened toward the solid portion.

2. The stud form of claim 1 wherein the connecting means includes at least one sleeve extending between the legs.

3. The stud form of claim 1 wherein each leg has a support flange extending therefrom for supporting a portion of an insulation panel.

4. The stud form of claim 3 wherein each flange has a plurality of projections for maintaining the insulation panel in position.

5. The stud form of claim 1 wherein each leg has a plurality of projections for securing an insulation panel adjacent thereto.

6. The stud form of claim 1 further characterized by insulation positioned between the legs, adjacent the face portion.

7. A preformed concrete wall panel comprising:

a solid portion;

a plurality of vertical concrete studs;

a plurality of stud forms, each associated with a vertical concrete stud and having:

a substantially U-shaped channel having a face portion that defines an elongated plane and leg portions that extend along side of and away from the elongated plane and define a predetermined channel depth around the associated stud; and means for integrally connecting the stud form to the solid portion of the wall panel; and a plurality of insulating panels extending between adjacent stud forms.

8. The preformed wall of claim 7 wherein the wall is a cavity wall.

9. The preformed wall of claim 7 wherein the wall is a planar wall.

10. The preformed wall of claim 7 wherein the insulation panels are supported by the stud forms.

11. The preformed wall of claim 7 further comprising top and bottom concrete beams.

12. The preformed wall of claim 11 further comprising a stud form associated with each beam and having at least two legs, one of the legs having a plurality of notches for receiving the stud forms associated with the vertical studs.

13. A system for forming preformed insulated concrete walls including a solid wall portion in a single pour, the system comprising:

a frame assembly that defines the overall perimeter of a wall;

means for forming top and bottom beams within the frame assembly;

a plurality of stud forms extending between the top and bottom beam forming means, each stud form including:

a substantially U-shaped channel having a face portion that defines an elongated plane and leg portions extending along side of and away from the elongated plane to define a predetermined channel depth; and means for integrally connecting the stud form to the solid portion of the wall panel with the channel opened toward the solid portion; and insulation panels extending between the top and bottom beam forming means and the stud forms.

14. The system of claim 13 wherein each beam forming means has an inner wall that includes a plurality of notches for receiving the stud forms.

15. The system of claim 14 wherein the positioning of the notches is variable.

16. The system of claim 13 wherein each beam forming means is a stud form having a plurality of notches for receiving the stud forms extending between the top and bottom beam forming means.

17. The system of claim 16 wherein the positioning of the notches is variable.

* * * * *